US008111163B2

(12) United States Patent
Utaka et al.

(10) Patent No.: US 8,111,163 B2
(45) Date of Patent: Feb. 7, 2012

(54) METHODS FOR MANUFACTURING AND APPLICATION OF RFID BUILT-IN CABLE, AND DEDICATED RFID READING SYSTEMS

(75) Inventors: Kenji Utaka, Hitachi (JP); Toshimi Yokota, Hitachiota (JP); Ryousuke Shigemi, Hitachi (JP); Chikara Ota, Soma (JP); Kenji Araki, Mito (JP); Kouichi Uesaka, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 405 days.

(21) Appl. No.: 11/600,850

(22) Filed: Nov. 17, 2006

(65) Prior Publication Data

US 2007/0120684 A1 May 31, 2007

(30) Foreign Application Priority Data

Nov. 18, 2005 (JP) ..... 2005-333519

(51) Int. Cl.
*G08B 13/14* (2006.01)

(52) U.S. Cl. ..... 340/572.8; 340/572.1; 340/572.4; 340/539.1; 340/13.36; 340/10.52; 340/10.1; 340/10.3; 340/8.1; 235/375; 439/488

(58) Field of Classification Search ..... 340/539.1, 340/539.13, 571, 572.1, 572.7, 572.8; 385/100–109
See application file for complete search history.

(56) References Cited

U.S. PATENT DOCUMENTS

| | | | | |
|---|---|---|---|---|
| 5,378,880 | A * | 1/1995 | Eberhardt | 235/439 |
| 5,910,776 | A * | 6/1999 | Black | 340/10.1 |
| 6,293,081 | B1 * | 9/2001 | Grulick et al. | 57/293 |
| 6,808,116 | B1 * | 10/2004 | Eslambolchi et al. | 235/492 |
| 6,968,994 | B1 * | 11/2005 | Ashwood Smith | 235/375 |
| 6,973,243 | B2 * | 12/2005 | Koyasu et al. | 385/100 |
| 7,084,768 | B2 * | 8/2006 | Hartmann et al. | 340/572.7 |
| 7,197,214 | B2 * | 3/2007 | Elkins et al. | 385/100 |
| 7,221,159 | B2 * | 5/2007 | Griffiths et al. | 324/318 |
| 7,588,185 | B2 * | 9/2009 | Berquist et al. | 235/385 |
| 2002/0034365 | A1 * | 3/2002 | Vogelsang | 385/100 |
| 2004/0069851 | A1 * | 4/2004 | Grunes et al. | 235/435 |
| 2004/0156601 | A1 * | 8/2004 | Koyasu et al. | 385/100 |
| 2004/0184747 | A1 * | 9/2004 | Koyasu et al. | 385/101 |
| 2005/0259930 | A1 * | 11/2005 | Elkins et al. | 385/100 |

FOREIGN PATENT DOCUMENTS

| | | |
|---|---|---|
| JP | 07-211158 | 8/1995 |
| JP | 2001-357366 | 12/2001 |
| JP | 2003-203527 | 7/2003 |
| JP | 2004-038583 | 2/2004 |
| JP | 2004-139535 | 5/2004 |

* cited by examiner

*Primary Examiner* — Daniel Wu
*Assistant Examiner* — Son M Tang
(74) *Attorney, Agent, or Firm* — Antonelli, Terry, Stout & Kraus, LLP

(57) ABSTRACT

Disclosed is a cable identifying system for accurately discriminating one cable from another on site over a long period of time, the system enabling a cable layer or a cable user, when laying out an RFID built-in cable, to do without manually writing any information in the RFID tags built in the cable. One cable having RFID tags built therein can be accurately realized. The individual ID's of the RFID tags are read and stored in a storage apparatus. When a part of the cable is cut, the ID's of the RFID tags nearest to the both end of the cable are read out, and the ID-related data of the RFID tags in the cut-out cable are recorded on a desired medium or electronic information medium.

15 Claims, 6 Drawing Sheets

FIG.2

| ADMINISTRATION NUMBER | CABLE TYPE | DATE OF FABRICATION | FABRICATION LINE | LOT NUMBER | OUTER DIAMETER | CABLE LENGTH | DATE OF SHIPMENT | SHIPPED TO: | RFID No.A | RFID No.B |
|---|---|---|---|---|---|---|---|---|---|---|
| P01 | CV | YMD | A4 | 370 | 12.5 | 150 | YMd | H-Co. | L238 | ··· |
| | ⋮ | | | | | | | | | |
| C02 | CVV | Ymd | E7 | 609 | 14.0 | 500 | NOT YET | NOT YET | J008 | ··· |
| | ⋮ | | | | | | | | | |

FIG.3

| ADMINISTRATION NUMBER | CABLE TYPE | DATE OF FABRICATION | FABRICATION LINE | LOT NUMBER | OUTER DIAMETER | CABLE LENGTH | DATE OF SHIPMENT | SHIPPED TO: | RFID No.A | RFID No.B |
|---|---|---|---|---|---|---|---|---|---|---|
| P01 | CV | YMD | A4 | 370 | 12.5 | 150 | YMd | H-Co. | L238 | ··· |
| | ⋮ | | | | | | | | | |
| C02 | CVV | Ymd | E7 | 609 | 14.0 | 300 | yMd | H-Co. | J008 | ··· |
| C02b | CVV | Ymd | E7 | 609 | 14.0 | 200 | yMd | I-Co. | J308 | ··· |
| | ⋮ | | | | | | | | | |

METHODS FOR MANUFACTURING AND APPLICATION OF RFID BUILT-IN CABLE, AND DEDICATED RFID READING SYSTEMS

INCORPORATION BY REFERENCE

The present application claims priority from Japanese application JP 2005-333519 filed on Nov. 18, 2005, the content of which is hereby incorporated by reference into this application.

FIELD OF THE INVENTION

This invention relates to the identification of cables; and more particularly to a system for discriminating one cable from another, the cable including therein RFID tags incorporating therein information memory devices storing therein the location data of the tags; methods for manufacture and application of the system; and an RFID reader dedicated to the RFID built-in cable.

BACKGROUND OF THE INVENTION

The RFID (radio frequency identification) technique that has recently been developed rapidly is a system wherein a radio transmitter/receiver called a reader/writer reads or writes information into or from, tags incorporating therein information memory devices without physical contact. This system, different from the bar-code reader or the magnetic card reader which needs physical contact, will be seldom affected by adverse surface conditions such as smears or blots. Also, with this system, reading/writing operation will be much simplified since for desired operations such tags have only to be placed or passed within a space which the reader/writer can cover in radio communication. Moreover, this system is advantageous over the bar-code technique in that since each tag may be provided with its individual ID, the system may hold much more storable information than the bar-code scheme. Accordingly, the RFID system has been regarded as a long-desired memory device and its application is becoming yet wider in various fields.

Cables laid in a plant or a railroad system have generally had their structure, material, and specification determined depending on their applications to power supply, signal detection or equipment control; the relationship between their service environments and useful life; and their costs. Most often used cables, however, are limited in their type, that is, only several types of cables are preferably used in most applications. They look all alike and therefore it is difficult to distinguish one from another by visual inspection alone.

In order to facilitate differentiation, various ideas have been reduced to practice: codes have been printed or labels have been stuck, onto cable surface or tags have been stringed to cable body. Such ideas include the printing of codes on the surface of cable at regular intervals in the manufacturing process for cable type identification and the tagging of cable with such information as cable number, start point of cable, end point of cable, etc. for individual differentiation.

Surface printing has a problem that the printed codes are subjected to abrasion or smearing during handling of cable in its layout operations. Tagging is risky in that tags may be torn off the cable during laying work, and also has a problem that since tagging is more laborious than printing, the provision of cable with tags at regular intervals for facility of identification will cause an increase in cost as the length of cable increases.

To solve a problem of how inexpensively and accurately one cable should be differentiated from another, JP-A-H07-211158 document discloses a cable structure wherein both resonant elements resonating with a radio signal having a predetermined frequency and information storage elements storing name data therein are introduced in the cable accommodating space.

In addition, JP-A-2004-139535 document discloses a cable structure wherein more than two information storage elements are arranged at intervals along the cable in its lengthwise direction and the elements are connected in series with one another with communication lines.

These cable structures still have room for improvement in that somewhat laborious work is necessary to record such information as names in the information storage elements whose number increases in proportion as the length of cable increases.

SUMMARY OF THE INVENTION

In general, communication distance is shorter in writing information into an RFID tag than in reading out information from the same RFID tag. Further, since the information to be written into the tag after the fabrication of cable is to be stored in a random access memory in the tag, it will be more easily degraded than the individual ID of the cable that is stored in a read-only memory incorporated in the tag. Namely, it is generally recognized that the random access memory is a little inferior to the read-only memory in record retaining capability.

In consideration of the issues described above, this invention aims to provide a system for inexpensively and accurately discriminating one cable from another over a long period of time by making the most of the excellent characteristics of the RFID built-in cable, methods for manufacture and application of the system and an RFID reader dedicated to the RFID built-in cable.

According to this invention, which has been made to attain the above described object, there is provided a cable identifying system used with RFID built-in cable including therein RFID tags, each RFID tag having a responder comprising a radio transmitter/receiver and a memory device, operable without physical contact, the system comprising an external information storage apparatus that is to store the entire information on the ID data stored in the memory devices incorporated in all the RFID tags included in the RFID built-in cable.

This invention also provides a cable identifying system used with RFID built-in cable, wherein the RFID built-in cable is laid out on the basis of the ID data stored in the external information storage apparatus.

This invention also provides a cable identifying system used with RFID built-in cable, wherein the RFID built-in cable is inspected on the basis of the ID data stored in the external information storage apparatus.

This invention also provides a cable identifying system used with RFID built-in cable wherein the RFID built-in cable is removed on the basis of the ID data stored in the external information storage apparatus.

This invention also provides a cable identifying system used with RFID built-in cable wherein the external information storage apparatus stores therein such ID data as the ID's and location data of all the RFID tags included in a length of cable as well as one of codes representing cable type, fabrication date, fabrication line, lot number, outer diameter of cable, and cable length all associated with the length of cable.

Moreover, according to this invention, which has been made to attain the above described object, there is provided a method for fabricating a cable identifying system used with RFID built-in cable including therein RFID tags, each RFID tag having a responder comprising a radio transmitter/receiver and a memory device, operable without physical contact, wherein an external information storage apparatus is fabricated that is to store the entire information on the ID data stored in the memory devices incorporated in all the RFID tags included in the cable.

This invention also provides a method for fabricating a cable identifying system used with RFID built-in cable, wherein the external information storage apparatus stores therein such ID data as the ID's and location data of all the RFID tags included in a cable as well as one of codes representing cable type, fabrication date, fabrication line, lot number, outer diameter of cable, and cable length all associated with the cable.

Further, according to this invention, which has been made to attain the above described object, there is provided a method for application of a cable identifying system used with RFID built-in cable including RFID tags therein, each RFID tag having a responder comprising a radio transmitter/receiver and a memory device, operable without physical contact, wherein the RFID built-in cable is inspected by using the ID data stored in the external information storage apparatus.

Furthermore, according to this invention, which has been made to attain the above described object, there is provided a method for application of a cable identifying system used with RFID built-in cable including therein RFID tags, each RFID tag having a responder comprising a radio transmitter/receiver and a memory device, operable Without physical contact, wherein the RFID built-in cable is removed by using the ID data stored in the external information storage apparatus.

This invention also provides a method for application of a cable identifying system used with RFID built-in cable, wherein the external information storage apparatus stores therein such ID data as the ID's and location data of all the RFID tags included in a cable as well as one of codes representing cable type, fabrication date, fabrication line, lot number, outer diameter of cable, and cable length all associated with the cable.

Still further, according to this invention, which has been made to attain the above described object, there is provided a cable identifying system used with RFID built-in cable including therein RFID tags, each RFID tag having a responder comprising a radio transmitter/receiver and a memory device, operable without physical contact, the system comprising an external information storage apparatus that is to store the entire information on the ID data stored in the memory devices incorporated in all the RFID tags included in the cable, wherein when the RFID built-in cable is laid out, the information on the layout is displayed.

This invention also provides a cable identifying system used with RFID built-in cable, wherein the direction in which the RFID built-in cable is to be laid out is displayed as visual image by using the information on the ID data stored in the external information storage apparatus.

Yet further, according to this invention, which has been made to attain the above described object, there is provided a cable identifying system used with RFID built-in cable including therein RFID tags, each RFID tag having a responder comprising a radio transmitter/receiver and a memory device, operable without physical contact, the system comprising an external information storage apparatus that is to store the entire information on the ID data stored in the memory devices incorporated in all the RFID tags included in the cable, wherein when the RFID built-in cable is inspected, the information on the RFID built-in cable is displayed.

This invention also provides a cable identifying system used with RFID built-in cable, wherein the direction in which the RFID built-in cable has been laid out is displayed as visual image by using the information on the ID data stored in the external information storage apparatus.

Furthermore, according to this invention, which has been made to attain the above described object, there is provided an RFID reader dedicated to a cable identifying system used with RFID built-in cable including therein RFID tags, each RFID tag having a responder comprising a radio transmitter/receiver and a memory device, operable without physical contact, the reader comprising a helical antenna contained in a cylindrical casing for retrieving information from RFID tags included in the RFID built-in cable in a wireless manner.

This invention also provides an RFID reader dedicated to a cable identifying system used with RFID built-in cable, wherein the cylindrical casing is made up of two semi-cylindrical members hinged on each other so as to be opened up.

This invention can provide a cable identifying system used with RFID built-in cable including therein RFID tags, capable of identifying an target cable accurately over a long period of time without such an operation as writing information into the RFID tags by a cable layer or user; a method for fabricating the cable identifying system; a method for application of the cable identifying system; and an RFID reader dedicated to the RFID built-in cable. The cable identifying system is especially effective when it is desired to remove a particular cable among a plurality of cables already laid out and to identify the particular cable which has both its ends unable to be identified.

BRIEF DESCRIPTION OF THE DRAWINGS

FIG. 2 shows an example of data format used in this invention;

FIG. 3 shows another example of data format used in this invention;

DESCRIPTION OF THE EMBODIMENTS

Embodiments of this invention will now be described with reference to the attached drawings.

Figure 1:
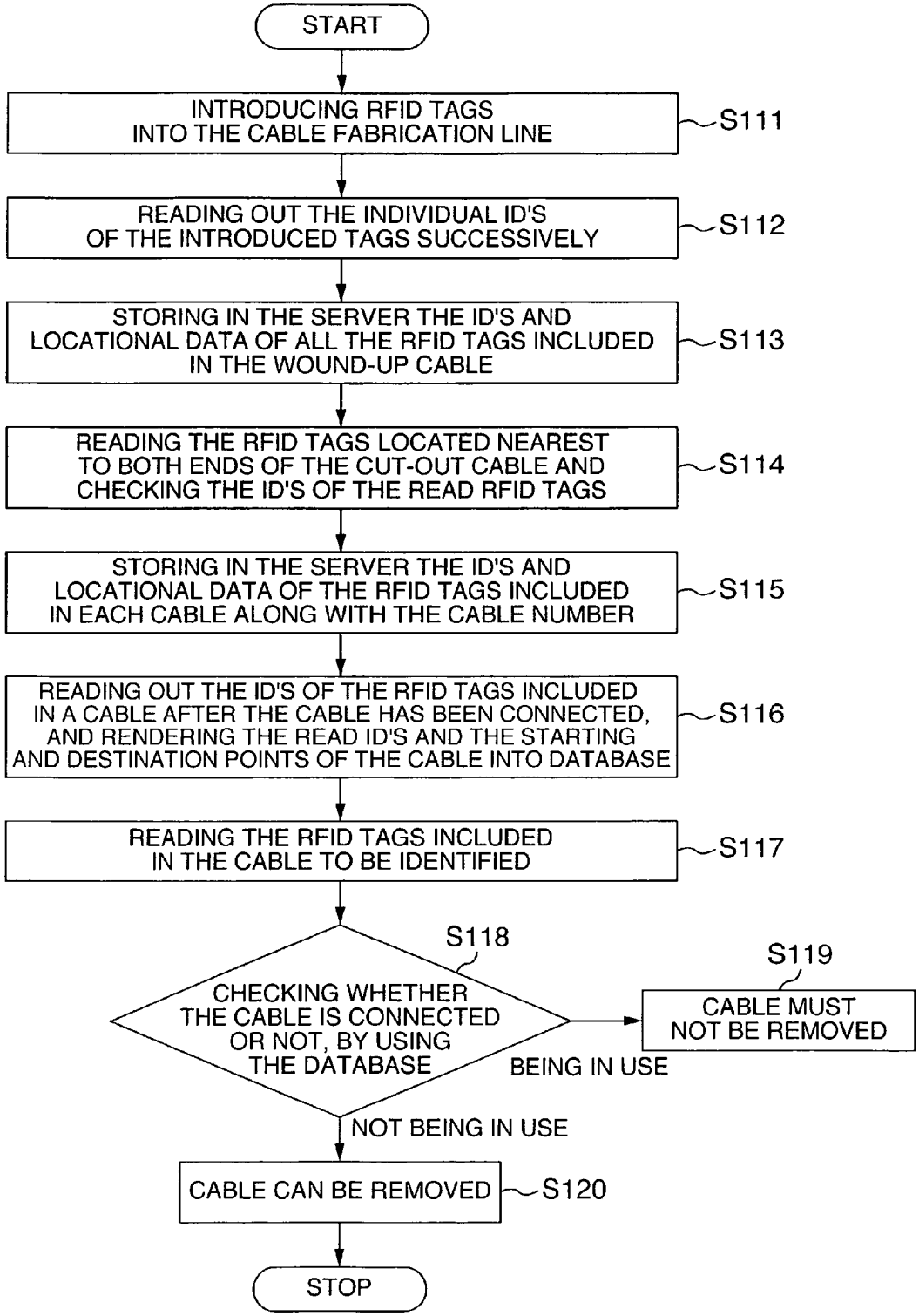
FIG. 1 is a flow chart illustrating the general concept of this invention.

FIG. 1 is a flow chart illustrating how a cable identifying system used with RFID built-in cable according to this invention, is operated.

Individual steps will be described in detail in the following.

RFID tags are first introduced in a cable fabricating line (step 111) and the individual ID's of the introduced RFID tags are then read out successively (step 112).

Figure 4:
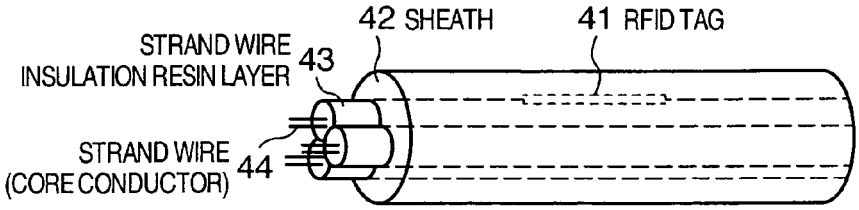
FIG. 4 is a perspective view of RFID built-in cable used in this invention.

Structural examples of a cable having RFID tags built therein, used in this invention will be described with reference to FIGS. 4, 5A and 5B.

In order to attach RFID tags onto a cable to be fabricated, RFID tags 41 are attached onto the internal structure of the cable before the last stage of cable fabricating process wherein sheath serving as the outermost layer of the cable is fabricated. For example, RFID tags may be directly stuck onto the insulation resin layer 43 of strand wires (conducting wires), or alternatively onto the structural material which serves to stabilize the shape of the bundle of the strand wire insulation resin layers 43, as described later with reference to FIG. 5(*a*). Then, the structural material with the RFID tags stuck thereon is passed to a step of fabricating sheath 42, with the result that cable having RFID tags within the sheath 42 is finally obtained.

With this constitution, RFID tags can be prevented from falling off the cable and moreover mechanical or thermal impact imposed externally on the RFID tags is mitigated so that the intended function of the RFID tags can be advantageously secured over a long period of time. If another method is employed wherein RFID tags are embedded in the sheath 42, there will be a high probability that cracks may originate at the points where the tags are embedded. According to the method embodying this invention, however, wherein the tags are put inside the sheath, such a problem of cracking will not arise.

Figure 5A:
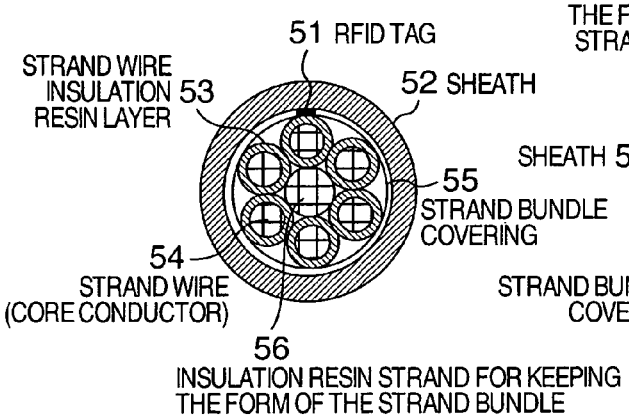
FIGS. 5A and 5B are cross sectional views of two different types of RFID built-in cables used in this invention.
Figure 5B:
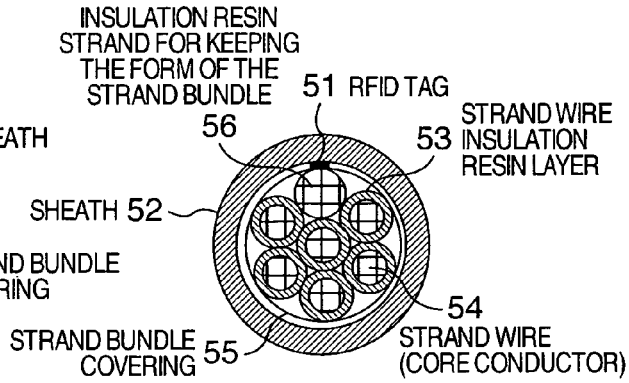

FIGS. 5A and 5B show in cross section the structures of cables used in this invention.

These cross sectional views illustrate the relative positioning relationship between RFID tag and the center of strands. In FIG. 5A, strand wires (conductor wires) 54 are covered by strand wire insulation resin layers 53; the strand wires 54 with their insulation resin layers 53 (this composite structure being hereafter referred to simply as cable strands), six in number, are bundled together around a central insulation resin strand 56 for keeping the form of the bundle; and the bundle is wrapped with a strand bundle covering 55. RFID tags are stuck onto the strand bundle covering 55 and a sheath 52 finally covers the strand bundle covering 55 with RFID tags stuck thereon. With this structure, the distance between an RFID tag and the outer surface of the sheath 52 can be made as short as possible so that communication can be facilitated between an RFID tag and the reader for reading out the information stored in the tag.

In FIG. 5B, unlike FIG. 5A, the central insulation resin strand 56 serving as a means for keeping the form of the strand bundle as shown in FIG. 5A is replaced in position by that one of six cable strands each composed of strand wires 54 and their insulation resin layer 53, which is located beneath the RFID tag. By doing this, the distance between an RFID tag and the nearest strand wire 54 can be made as large as possible so that the interference of electromagnetic waves can be prevented when information is read out from the RFID tag in a wireless fashion.

Now, with reference to FIG. 6, a step (step 113 shown in FIG. 1) will be described of storing into a server (not shown) the individual ID's and location data memorized in all the RFID tags built in a wound-up cable.

Figure 6:
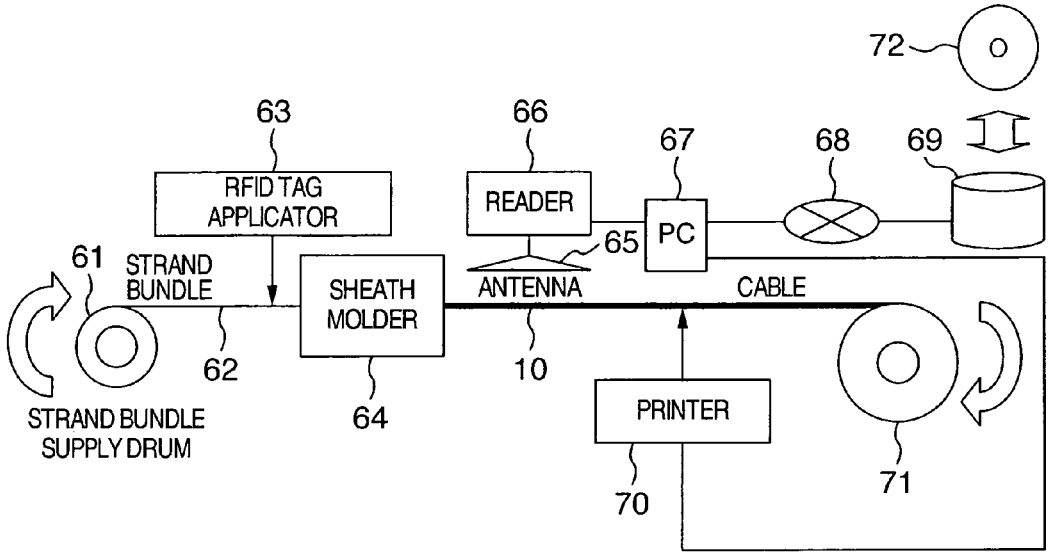
FIG. 6 schematically shows a cable identifying system according to this invention, wherein the fabrication of RFID built-in cable is illustrated.

FIG. 6 shows a system for fabricating a cable according to this invention and the process of fabricating such a cable system.

A composite strand 62 consisting of, for example, cable strands and insulation resin strand is unwound from a strand bundle supply drum 61. An RFID tag applicator 63 sticks RFID tags onto the composite strand 62 at (regular) intervals. After this step, a sheath molder 64 provides sheath for the composite strand with RFID tags stuck thereon and a RFID tag built-in cable is finally completed. An RFID reader 66 provided with an antenna 65 reads out the individual ID's of the RFID tags while the RFID tag built-in cable 10 is being fed to a cable take-up drum 71. These individual ID's, after being sent to a computing apparatus 67 such as a personal computer, are stored in a server 69 via a communication channel 68 such as the internet. In this way, the server 69 stores the individual ID's and the location data memorized in all the RFID tags included in the cable 10. The server 69, which is used to store the information on fabricated cables, is administrated by a cable manufacturer. Accordingly, when a cable user asks the manufacturer about such information as the fabrication date of a certain cable, the manufacturer can search for such a fabrication history as which manufacturing line has produced the cable in question or what lot number the cable has, on the basis of the individual ID's of the RFID tags.

Further, those RFID data on all the RFID tags included in a certain cable which are stored in the server 69, may be transferred, if necessary, onto such electronic information media as paper, magnetic tape, memory or CD.

Furthermore, when the cable is taken up, being wound up on the cable take-up drum 71, a printing apparatus 70 prints codes on the sheath of the cable at the predetermined locations thereof selected through calculation on the basis of the position of the reader 66 and the wind-up speed. Thus, the approximate positions of the built-in RFID tags in the cable can be located. The printed codes may indicate the information on either the classification of cables or the individual ID's of the RFID tags. By inspecting the printed codes, the type of the cable under inspection, the approximate position of each RFID tag, or the individual ID's of the RFID tags can be read out.

FIG. 2 illustrates an example of RFID tag data to be stored in the server 69. A piece of the data for each administration number chosen arbitrarily by a cable manufacturer, contains not only such specification data as cable type, fabrication date, manufacturing line number, lot number, outer diameter, length of cable, but also the individual ID's and location data of all the RFID tags included in the cable of interest. Moreover, a data piece for cable after shipment may include such information as the date of shipment and the destination of shipment. Additional data not mentioned above such as electric properties may also be included as administration data, if necessary.

Accordingly, if a manufacturer ships to a user a cable with paper or electronic information media 72 stringed thereto, bearing the RFID tag data of all the RFID tags included in the cable, then the user can ask the manufacturer about the information on the cable in use on the basis of the individual ID's of the RFID tags. Or alternatively, the user himself can make administration and discrimination of cables on the basis of the individual ID's of the RFID tags included in the cables.

It is to be noted here that no cable manufacturer, layer nor user need to write any data in the tags. Namely, the individual ID's of the RFID tags, none of which is identical with one another, are read out at the time of cable fabrication and the read ID's are stored as the location data for the RFID tags per cable so that the individual identification of the cable can be made by reading an arbitrary RFID tag included in the cable of interest.

Figure 7:
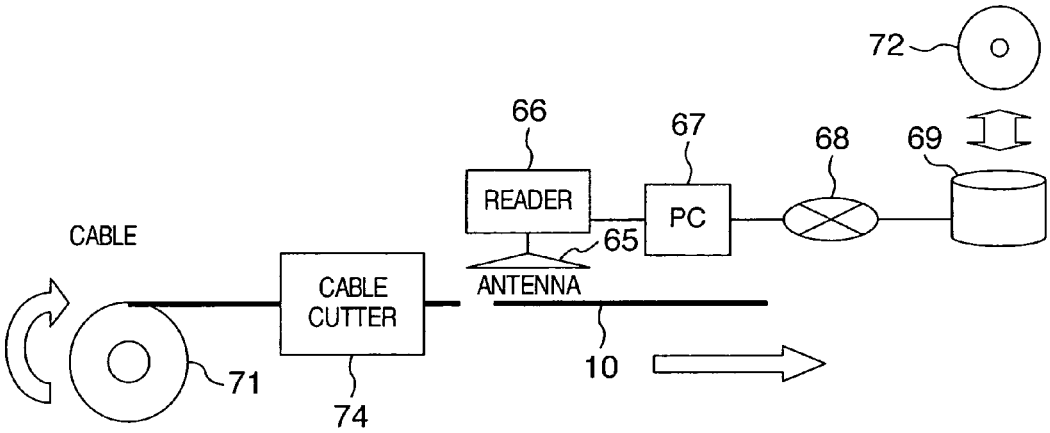
FIG. 7 schematically shows a cable identifying system according to this invention, wherein the way of RFID built-in cable being cut out is illustrated.

Step 114 will now be described with reference to FIG. 7, wherein when a length of the cable wound on the cable take-up drum 71 shown in FIG. 6 is wound off and cut out, the RFID tag located nearest to either end of the cut-out cable is read and the RFID tags included in the cut-out cable are identified.

The cable 10 is wound off from the cable take-up drum 71 and cut out by means of a cable cutter 74. The individual ID of the RFID tag located nearest to either end of the cable segment 10 is read out by means of an RFID reader 66 having an antenna 65. The individual ID read out of the tag is compared with the RFID tag data stored in a server 69 by way of a computing apparatus such as a personal computer 67 and a communication channel 68.

The individual ID's and location data of the RFID tags included in each cut-out cable along with a particularly given administration number, are stored as database in the server 69 (step 115). In this way, the correspondence of the ID's of the first and the last RFID tags included in the cut-out cable to the specific locations in the uncut original cable can be found and memorized in the server 69, and also the cable type, fabrication date, fabrication line, lot number, outer diameter of the cut-out cable, and the individual ID's and location data of all the RFID tags included in the cut-out cable can be memorized in the server 69.

Alternatively, a fully automatic system may be devised wherein when a length of RFID built-in cable is cut out, the RFID tags nearest to the cut ends of the cut-out cable are read and the read individual ID's are automatically transmitted to the server.

FIG. 3 shows another example of data on the RFID tags to be stored in the server 69. For the RFID built-in cable which has been shortened as a result of cutting, the data representing the cable length, and the individual ID's and locations of the RFID tags included in the cut cable are renewed. For the RFID built-in cable which needs to be newly administrated as a result of cutting, a new administration number is employed and the post-cutting data such as cable length and the individual ID's and location data of the RFID tags included in the cut cable, are stored along with the newly employed administration number in the server 69 while the pre-cutting cable data as shown in FIG. 2 is basically maintained.

Then, when the cut-out RFID built-in cable is laid out, the individual ID's of the RFID tags included in the cut-out cable are read out and combined with the data giving the starting point and the destination, and the combined data are turned into database (step 116). Here, it goes without saying that each segmented cable must be provided with its specific database which consists of the ID's and the location data of the RFID tags built in the segmented cable, and such information as the cable starting point and the cable destination point for the segmented cable.

The step of removing the RFID built-in cable, after it was laid out, will be described. Any RFID tag included in a particular cable to be identified is read by the RFID reader 66 (step 117). The connection status of the particular cable, i.e. whether it is connected with any other cable or any electrical appliance, is checked (step 118). Thus, when any of the RFID tags included in an arbitrary cable which was laid out, is read, the information on the individual ID tag such as administration number is fetched from the database depending on the read RFID tag so that the connection status of the cable of interest can be retrieved and checked.

Consequently, if the cable under consideration is found connected with any electrical circuit, it should not be removed (step 119). On the other hand, if the cable is not in use at all, it is determined that the unused cable can be safely removed (step 120). The conventional cable identification system has suffered a problem that since it has a relatively low capability of individual identification of a laid cable which needs to be removed, repeated checks are required before actual removing operation, resulting in increased time, labor and cost for cable removal. This invention can eliminate such drawbacks of the conventional system.

In the above embodiment of this invention, the effect of accurately selecting a cable to be removed among a plurality of cables has been described. The concept of this invention, however, is not limited in application to the judgment for cable removal, but can also be applied to a wide variety of fields since it is an art to securely identify an intended cable among a plurality of cables.

The next embodiment will be described as applied to a case where a RFID built-in cable used in this invention is laid out in a building.

Figure 8:
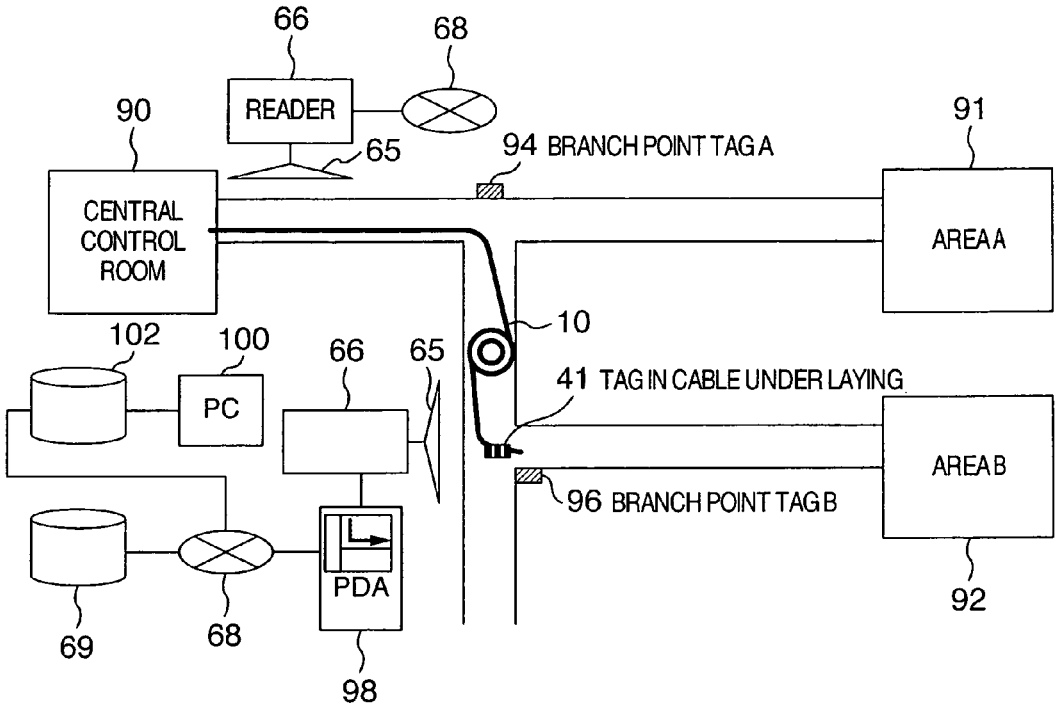
FIG. 8 schematically shows a cable identifying system according to this invention, as applied for laying out RFID built-in cable in a power plant.

FIG. 8 shows an embodiment of this invention wherein an RFID built-in cable is laid out in a building such as a power plant. In this embodiment, it is required to connect between the central control room 90 and the area B 92 by way of a cable 10. In actual work of layout, the RFID reader 66 reads out the individual ID's of the RFID tags included in the cable 10, and the read individual ID's are referred to the corresponding database stored in the server 69 via such a communication channel as the internet. The referred database of the server 69 is in turn referred, via the communication channel 68, to the layout database stored in the server 102 of the CAD system 100 which stores the layout information of the entire plant. Accordingly, the server 69 determines the starting and ending points in layout of the cable under consideration and also fetches map data for cable layout and stores it.

The process corresponding to the step 116 shown in FIG. 1 will now be described wherein an RFID built-in cable 10 is laid out connecting between the central control room 90 and the area B 92. In such a case, the cable 10 with both its ends folded is usually brought to a place located near at the middle point in the layout path, and the folded ends are unfolded at actual layout operation. The individual ID of the RFID tag located near at the middle point of the cable 10 is referred to the database of the server 69 via the communication channel 68. As a result, there is stored in the server 69 the information on the geographical relationships among the individual ID's and the location data of the RFID tags included in the cable to be laid out, and the starting and ending points in layout of the cable 10. Then, the layout database of the server 102 is accessed via the communication channel 68, and the geographical information on where the cable 10 with its both ends folded should be brought is retrieved from the map data for cable layout stored in the server 102. Or alternatively the individual ID of the RFID tag located near at the middle point of the cable 10 is first read out by the RFID reader 66, and then the place to which the cable 10 should be brought may be determined by reading out, likewise by means of the RFID reader 66, the individual ID's of the branch point RFID tags located at branch points in the plant.

When one of the folded ends of the cable 10 is unfolded and passes near a branch point, the individual ID of the branch point RFID tag B96 located at the branch point is read out by the RFID reader 66, and the individual ID of the RFID tag coming nearest to the same branch point is simultaneously read out by the RFID reader 66. Accordingly, by referring the location data from the branch point tag B96 and the individual ID of the RFID tag of the cable 10 nearest to the branch point tag B96 to the database of the server 96, the map data for cable layout and the direction in which the cable 10 is to be laid out are retrieved from the database of the server 96 so that the cable layout path and its direction are displayed on an information apparatus 98 such as a PDA. Consequently, a cable layer can be provided with accurate information on how cables should be laid out.

In stead of automatically reading out the location data from the branch point tag B96 by the RFID reader 66, the location data of the branch point may be manually input in the information apparatus 98. By doing this, the map data for cable layout can be retrieved from the database of the server 96 so that the cable layout path and its direction can be likewise displayed on an information apparatus 98 such as a PDA.

Figure 9:
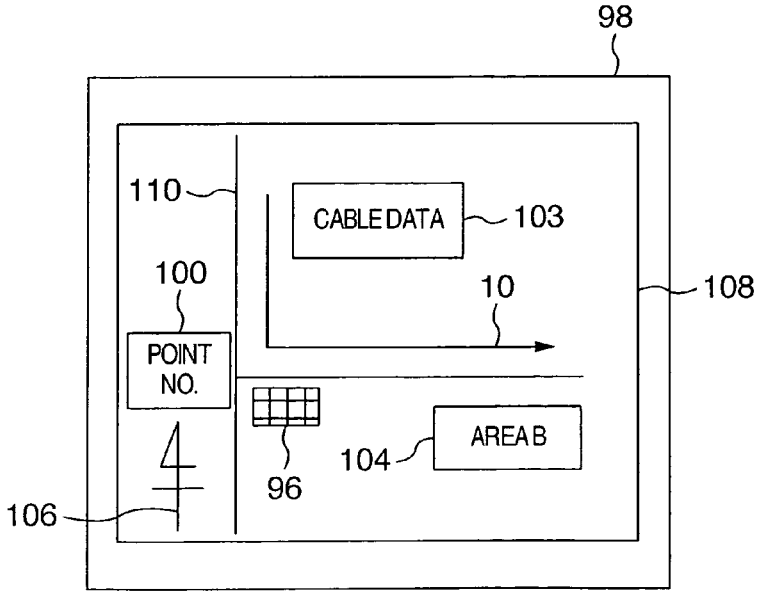
FIG. 9 shows how the information processor of the cable identifying system according to this invention displays the information useful in cable layout.

FIG. 9 shows items to be displayed on the information apparatus in FIG. 8.

On the display screen 108 of the information apparatus 98 are displayed a cable layout path 110 having branch points together with the associated layout direction 106, the branch point identifying data 100, and such directional information 104 as to indicate the destination of the path 10. Namely, the RFID tags included in the cable 10 to be laid out are read by the RFID reader 66, and, on the basis of the read out ID's, the information on the direction in which the cable layout path 110 should follow to reach an intended area is displayed together with cable data 103. The cable data 103 includes such various RFID tag data as associated with the individual ID's and the directional information associated with the cable 10, which are both displayed. In this way, a cable layer can be provided with directional information which enables the layer to securely lay out cables without errors.

Another embodiment of this invention will now be described wherein the RFID built-in cable, which has been laid out in a building, is to be inspected and also removed.

Figure 10:
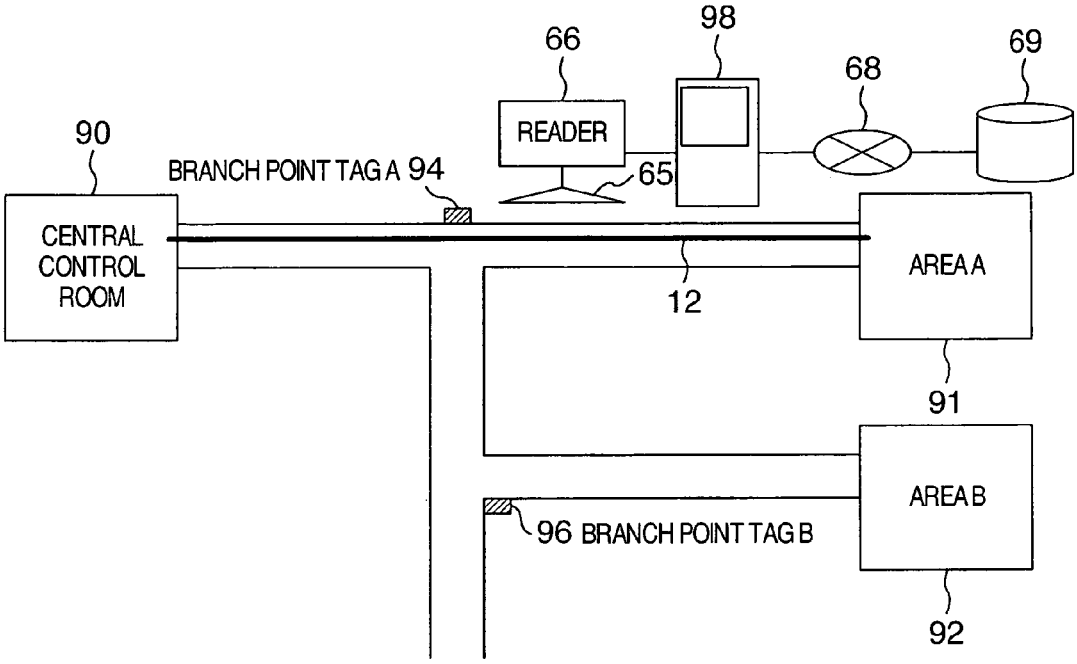
FIG. 10 schematically shows a cable identifying system according to this invention, as applied for inspection and removal of RFID built-in cable already laid out in a power plant.

FIG. 10 shows such an embodiment wherein the RFID built-in cable is laid out in a building like, for example, a power plant.

In this embodiment, a cable 12 is laid out between a central control room 90 and an area A 91. As a process corresponding to the step 118 in FIG. 1, the individual ID's of the RFID tags included in the cable 12 are read out by the RFID reader 66, and the read ID's are referred to the database stored in the server 66 via such a communication channel as the internet. Then, this database of the server 66 is in turn referred to the layout database (not shown) of the server 102 of the CAD system 100 which stores the layout data of the entire plant, via the communication channel 68. Accordingly, the server 102 sends back data indicating that the cable connects between equipment in the central control room 90 and equipment in the area A 91 and that the cable 12 is now in use. Consequently, an indication is made on whether the cable 12 can be removed or not, and this fact along with the result of cable inspection is conveyed to an operator.

Figure 11:
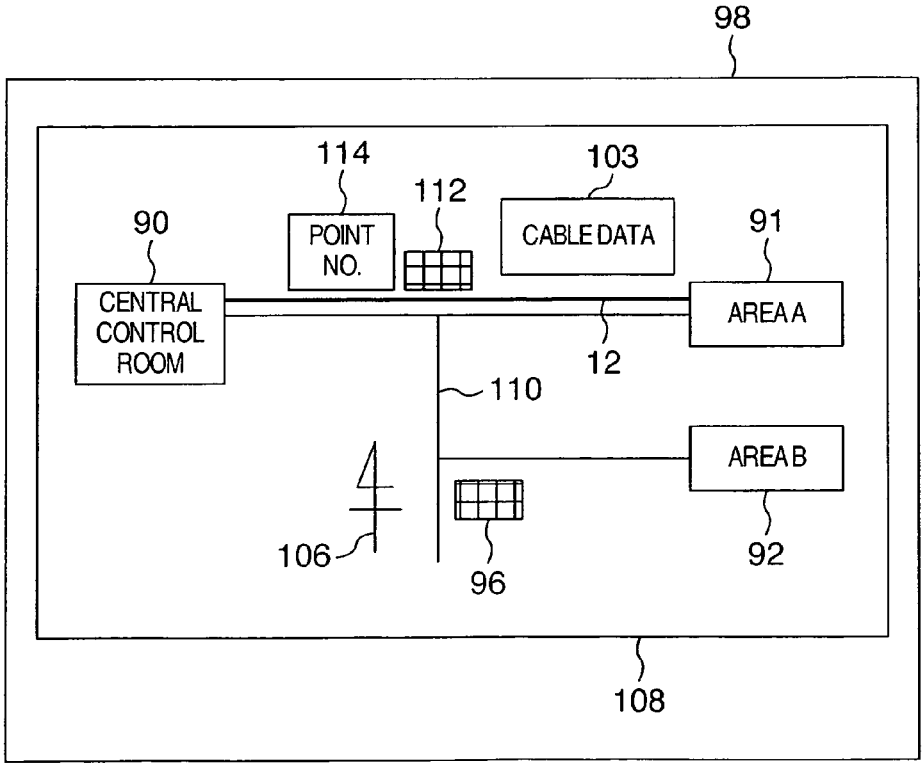
FIG. 11 shows how the information processor of the cable identifying system according to this invention displays the information useful in cable inspection and removal.

FIG. 11 shows items to be displayed on the information apparatus in FIG. 10.

On the display screen 108 of the information apparatus 98 are displayed a cable layout path 110 for the cable 12, together with the associated layout direction 106, the branch point data 114 for discriminating one branch from another, and such directional information 104 as to which area the destination of the path 10 is. Namely, the RFID tags included in the cable 10 to be laid out are read by the RFID reader 66, and, on the basis of the read out ID's, the information that the cable 12 connects between the central control room 90 and the area A 91 is displayed together with cable data 103. The cable data 103 includes such various RFID tag data as associated with the individual ID's and such information as whether the cable 12 is in use or whether it can be removed or not.

Figure 12:
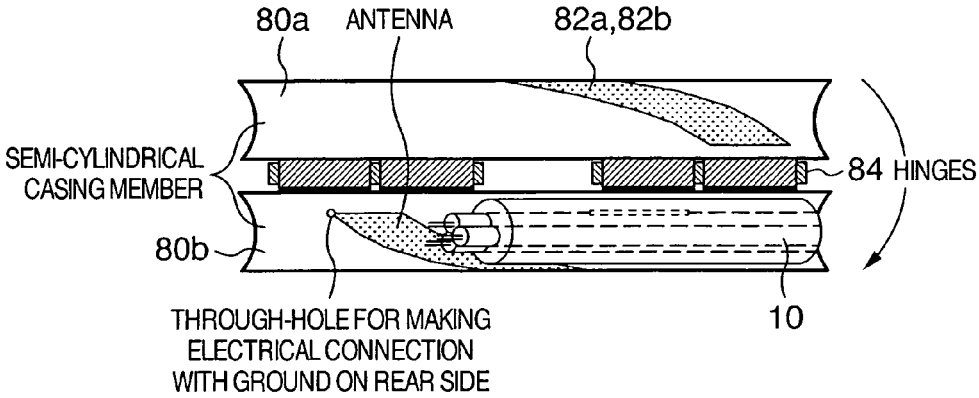
FIG. 12 shows the structure of an antenna used in an RFID reader according to this invention.

FIG. 12 shows an exemplary structure of an antenna 65 used for the RFID reader 66.

The antenna 65 has a pair of semi-cylindrical members 80*a* and 80*b* connected with each other by means of hinges 84. In reading an RFID tag, the cable 10 is inserted in a cylinder formed by closing the hinged, semi-cylindrical members 80*a* and 80*b*. Helical antenna segments 82*a* and 82*b* are attached to the inner surfaces of the semi-cylindrical members 80*a* and 80*b*. The end of one of the members is electrically connected via a through-hole 86 with the ground conductor resting on the outer surfaces of the semi-cylindrical members 80*a* and 80*b*. By using this type of antenna, the exact location of each RFID tag cannot be detected, but the information from the antenna incorporated in the RFID tag can be effectively detected irrespective of the position of the tag in the cable. Moreover, if the length of the antenna 82*a* and 82*b* along the cable 10 is made greater than the interval between the adjacent RFID tags included in the cable 10, the radio waves from the RFID tags can be securely detected irrespective of whatever position of the cable along its entire length is within the cylindrical antenna 65.

In the foregoing description, the cables are limited to electrical cables each of which comprises electrical conductors, but it goes without saying that this invention can also be applied to a case where optical fiber cables are used. Moreover, instead of using RFID tags in which the memorized data cannot be supplemented or renewed, tags whose memorized data can be supplemented or renewed can also be used.

In the embodiments described above, the data read out of the individual ID tags are stored as database in the server 69 via the communication channel 68, but a personal computer can also be used instead of the RFID reader 66, if the content of the database is stored in the electronic information storage medium 72 and if such personal computers can be provided with a function of the RFID reader 66 while the content of the electronic information storage medium 72 is transferred to the personal computer.

According to this invention, therefore, there can be provided a cable identifying system for accurately discriminating one cable from another over a long period of time when cables having RFID tags included therein are removed or maintained; methods for fabrication and application of the cable identification system; and an RFID reader dedicated to the system. As a result, using this invention, a cable layer or a cable user, when laying out an RFID built-in cable, need not manually write any information in the RFID tags built in the cable.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A cable identifying system used with a RFID built-in cable having an administrative number and including RFID tags therein, each RFID tag having a responder comprising a radio transmitter/receiver and a memory device, operable without physical contact, the system comprising an external information storage apparatus to store an entire information of ID data stored in the memory device of each of a plurality of RFID tags of the RFID built-in cable, and a branch point RFID tag showing location data including data on a branch point within a path along which the RFID built-in cable is to be laid out, another external information storage apparatus to store information, associated with the administrative number, on a path along which the RFID built-in cable is to be laid out, the RFID built-in cable being arranged to be laid out on a basis of referencing both the ID data stored in the memory devices and in the external information storage apparatuses, ID data stored in the memory devices of the plurality of RFID tags of the RFID built-in cable and the location data having been stored in a memory device of the branch point RFID tag, being read without physical contact, wherein directional information on the path is arranged to be displayed with detecting a branched path at the branch point to which the RFID built-in cable forwards by referring to information stored in the external information storage apparatus and information stored in the another external information storage apparatus, in accordance with the ID data and the location data of the branch point RFID taq.

2. A cable identifying system as claimed in claim 1, wherein the external information storage apparatus stores therein as at least part of the ID data, ID's and location data of all the RFID tags included in a cable as well as one of codes representing cable type, fabrication date, fabrication line, lot number, outer diameter of cable, and cable length all associated with the cable.

3. A cable identifying system as claimed in claim 1, wherein a direction in which the RFID built-in cable is to be laid out is displayed as a visual image by using the information on the ID data stored in the external information storage apparatus.

4. The cable identifying system according to claim 1, wherein the information on location comprises a cable layout-path and a direction of the path.

5. A cable identifying system as claimed in claim 1, wherein the RFID tags are embedded internally within a sheath of the cable and distributed along a cable-body-length thereof, and with each memory device of each said RFID tag storing unique said ID data which is unique to the RFID tag in comparison to ID data of other RFID tags of the plural RFID tags.

6. A method for application of a cable identifying system used with a RFID built-in cable having an administrative number and including RFID tags therein, each RFID tag having a responder comprising a radio transmitter/receiver and a memory device, operable without physical contact, the method comprising storing an entire information of ID data stored in memory devices of all the RFID tags of the RFID built-in cable in an external information storage apparatus, including a branch point RFID tag showing location data including data on a branch point within a path along which the RFID built-in cable is to be laid out, storing information, associated with the administrative number, for a path along which the RFID built-in cable is to be laid out, in another external storage apparatus, laying out the RFID built-in cable on a basis of referencing both the ID data stored in the memory devices and in the external information storage apparatus, and ID data stored in the memory devices of the RFID built-in cable, and location data stored in the memory device of the branch point RFID tag, being read without physical contact, wherein directional information on the path is arranged to be displayed with detecting a branched path at the branch point to which the RFID built-in cable forwards by referring to information stored in the external information storage apparatus and information stored in the another external information storage apparatus, in accordance with the ID data and the location data of the branch point RFID tag.

7. A method as claimed in claim 6, wherein the external information storage apparatus stores therein as at least part of the ID data, ID's and location data of all the RFID tags included in each length of cable as well as one of codes representing cable type, fabrication date, fabrication line, lot number, outer diameter of cable, and cable length all associated with the length of cable.

8. A method as claimed in claim 6, wherein a direction in which the RFID built-in cable has been laid out is displayed as a visual image by using the information on the ID data stored in the external information storage apparatus.

9. A method as claimed in claim 6, wherein the RFID tags are embedded internally within a sheath of the cable and distributed along a cable-body-length thereof, and with each memory device of each said RFID tag storing unique said ID data which is unique to the RFID tag in comparison to ID data of other RFID tags of the plural RFID tags.

10. A cable identifying system used with a discrete RFID built-in cable including plural RFID tags embedded internally within a sheath of the cable and distributed along a cable-body-length thereof, each RFID tag having a responder comprising a radio transmitter/receiver and a memory device storing unique ID data which is unique to the RFID tag in comparison to ID data of other RFID tags of the plural RFID tags, the RFID tag being operable without physical contact, the system comprising an external information storage apparatus storing the unique ID data stored in the memory devices incorporated in a pair of the plural RFID tags of the RFID built-in cable, as cable identifying information, the pair of the plural RFID tags being at opposing ends of the RFID built-in cable, and the external information storage apparatus further storing the unique ID data stored in a branch point RFID tag showing location data including data on a branch point within a path along which the RFID built-in cable is to be laid out;

wherein directional information on the path is arranged to be displayed with detecting a branched path at the branch point to which the RFID built-in cable forwards by referring to information stored in the external information storage apparatus and information stored in another external information storage apparatus detailing a path along which the RFID built-in cable is to be laid out, in accordance with the ID data and the location data of the branch point RFID tag.

11. A cable identifying system as claimed in claim 10, wherein the RFID built-in cable is inspected on a basis of the cable identifying information stored in the external information storage apparatus.

12. A cable identifying system as claimed in claim 10, wherein the RFID built-in cable is removed on a basis of the cable identifying information stored in the external information storage apparatus.

13. A cable identifying system as claimed in claim 10, wherein the external information storage apparatus stores therein as at least part of the cable identifying information, ID's and location data of all the RFID tags included in a cable as well as one of codes representing cable type, fabrication date, fabrication line, lot number, outer diameter of cable, and cable length all associated with the cable.

14. A cable identifying system as claimed in claim 10, wherein a direction in which the RFID built-in cable is to be laid out is displayed as a visual image by using the information on the cable identifying information stored in the external information storage apparatus.

15. A cable identifying system used with an RFID built-in cable having an administrative number and including a plurality of RFID tags therein, each RFID tag having a responder comprising a radio transmitter/receiver and a memory device, operable without physical contact, the system comprising:

an external information storage apparatus, to store an entire information of ID data stored in the memory device of each of the plurality of RFID tags of the RFID built-in cable, a branch point RFID tag showing location data including data on a branch point within a path along which the RFID built-in cable is to be laid out, and another external information storage apparatus to store information, associated with the administrative number, for a path along which the RFID built-in cable is to be laid out, wherein both ID data having been stored in the memory devices of the plurality of RFID tags of the RFID built-in cable and the location data having been stored in a memory device of the branch point RFID tag are arranged to be read without physical contact, and wherein directional information on the path is arranged to be displayed with detecting a branched path at the branch point to which the RFID built-in cable forwards by referring to information stored in the external information storage apparatus and information stored in the another external information storage apparatus, in accordance with the ID data and the location data of the branch point RFID tag.

* * * * *